United States Patent [19]

Miselli et al.

[11] Patent Number: 4,854,930

[45] Date of Patent: Aug. 8, 1989

[54] APPARATUS FOR THE SUPPLY OF BLANKS OF PACKAGING MATERIAL AND IN PARTICULAR FOR THE SUPPLY AND ERECTION OF FLAT FOLDED TUBULAR BLANKS AS PACKAGING CASES IN "BLISTER" PACKAGING MACHINES

[75] Inventors: Carlo A. Miselli, Castel San Pietro Terme; Rino Conti, Ozzano Emilia, both of Italy

[73] Assignee: I.M.A. - Industria Macchine Automatiche - SPA, Ozzano Emilia, Italy

[21] Appl. No.: 205,425

[22] Filed: Jun. 10, 1988

[30] Foreign Application Priority Data

Jul. 30, 1987 [IT] Italy ..... 3579 A/87

[51] Int. Cl.[4] ..... B31B 3/12; B31B 3/78

[52] U.S. Cl. ..... 493/315; 493/317

[58] Field of Search ..... 493/315, 317

[56] References Cited

U.S. PATENT DOCUMENTS 2,601,481 6/1952 Williams ..... 493/315

4,735,600 4/1988 Drewke et al. ..... 493/315

FOREIGN PATENT DOCUMENTS 1017056 of 0000 United Kingdom .

2053133 of 0000 United Kingdom .

*Primary Examiner*—Robert P. Olszewski

*Assistant Examiner*—Jack Lavinder

*Attorney, Agent, or Firm*—Herbert Dubno

[57] ABSTRACT

An apparatus for the supply from a fixed store of blanks of packaging material preferably of the type having a flat folded tubular structure comprising a support wheel provided with a continuous rotary movement bearing one or a plurality of angularly uniformly spaced articulated systems which project peripherally. Each of these articulated systems has one of its opposite rods developing in a piecewise linear manner with the third rod articulated at an intermediate point of the section of this piecewise linear development which projects peripherally to the greatest extent. The articulations on the bridge of these opposite rods of the articulated system have a cam follower structure operating with a corresponding cam, suction member means for the take up of the blanks in individual sequence from the fixed store being provided at the free end of this section of the piecewise linear development which projects peripherally to the greatest extent.

3 Claims, 3 Drawing Sheets

APPARATUS FOR THE SUPPLY OF BLANKS OF PACKAGING MATERIAL AND IN PARTICULAR FOR THE SUPPLY AND ERECTION OF FLAT FOLDED TUBULAR BLANKS AS PACKAGING CASES IN "BLISTER" PACKAGING MACHINES

FIELD OF THE INVENTION

The present invention relates to an apparatus for the supply of blanks of packaging material and, more particularly, to the supply and erection of flat folded tubular blanks as packaging cases in blister packaging machines.

BACKGROUND OF THE INVENTION

Apparatus is already known in the packaging field which operates discontinuously or continuously and is designed to supply blanks of packaging material in individual sequence by taking up these blanks, which may be of the type having a flat folded tubular structure, stacked or disposed side by side in a hopper store, and erecting this type of blank with a flat tubular structure during its extraction from the store for the supply stage by means of an operation to expand it into its tubular shape so that it can receive the product or products to be packaged.

In the case of continuously moving apparatus in this specific technological field of packaging, operating speeds tend to be increasingly greater with the passage of time as a result of refinements to the structures designed to cause the mechanisms with suction components, which are continuously rotated for the take up of the blanks from the store, to have the necessary steps. These structures, designed to cause these mechanisms with suction take up components rotated continuously in order to enable the take up of the blanks from the store to pause, substantially comprise a support wheel provided with a continuous rotary movement bearing one or more simple articulated systems (articulated quadrilaterals) projecting from its periphery, one of its rods (rocker arm) being structured, for example, in an elastically telescopic manner with its articulation on the bridge of the quadrilateral articulated loosely, the articulation of the opposite rod or rocker arm on this bridge being formed as a double cam follower operating alternately in the cycle (see British Patent Specification No. 1 017 056).

In practice, the articulated quadrilateral structures operated in this way, although causing the respective mechanisms with suction take up members to pause (these members having a reciprocating motion perpendicular to the plane in which the blanks lie in the fixed store for the take up of the corresponding blank from the store during their displacement with a continuous movement), to some extent limit the unit operating speed of these supply apparatus. Attempts to simplify the structure of these articulated quadrilaterals in order to increase the unit operating speed of these supply apparatus by constructing the articulation on the bridge of the cam follower rod or rocker arm with a single cam follower and leaving the structure and the articulation on the bridge of the opposite, simply articulated, rod unchanged, have not in practice made it possible to implement the required pause with the correspondingly required reciprocating movement of the relative mechanism with a component for taking up the blanks from the store (see British Patent Specification No. 3 053 133).

OBJECTS OF THE INVENTION

The main object of the present invention is thus to provide an improved apparatus for the supply of blanks of packaging material and, more particularly, for the supply and erection of flat folded tubular blanks as packaging cases in blister packaging machines of the above-mentioned type with mechanisms having suction members which pause and have a reciprocating movement for the take up of blanks from the store caused to move continuously via an articulated system which enables a high unit operating speed or a high operating speed per unit of time.

A further object of the present invention is to provide an improved apparatus of the type described having mechanisms with suction members caused to move continuously with pauses and a reciprocating movement for taking up the blanks from the store via an articulated system which enables a high operating speed per unit of time, in which the articulated system is constructed so as to operate similarly to a composite articulated system.

Still another object of the invention is to provide an improved apparatus having mechanisms with suction members caused to move continuously, wherein the suction members pause and have a reciprocating movement for the take up of the blanks from the store via an articulated system which enables a high operating speed per unit of time, in which the articulated system is constructed in a particularly simple manner so as to be able, in addition to causing these mechanisms with suction members to pause and perform this reciprocating movement for the take up of the blanks in individual sequence, to bring their speed in line with the various operating requirements for the blanks within a single operating cycle for the blanks.

SUMMARY OF THE INVENTION

These and other objects which will become apparent hereinafter are all achieved by the apparatus of the invention for the supply from a fixed store of blanks of packaging material and in particular for the supply and erection of flat folded tubular blanks as packaging cases in blister packaging means. According to the invention, the apparatus comprises a support wheel with a continuous rotary movement bearing one or more angularly uniformly spaced articulated systems projecting from its periphery, each of the articulated systems has one of its opposite rods (rocker arms) with a longitudinal piecewise linear development, the other rod (connecting rod) being articulated at an intermediate point of the section of this piecewise linear development which projects peripherally to the greatest extent. The articulations on the bridge of the articulated system of these opposite rods have a cam follower structure operating with a corresponding cam at the free end of this section of the piecewise linear development which projects peripherally to the greatest extent, a suction member means is supported with a reciprocating movement and an interposed pause for the take up of the blanks in individual sequence from the fixed store under the action of the individual cam follower structures.

BRIEF DESCRIPTION OF THE DRAWING

Further characteristic features and advantages of the invention will become apparent from the following description of a preferred, but not exclusive, practical embodiment given purely by way of non-limiting example and shown in the accompanying drawing, in which.

DESCRIPTION

Figure 1:
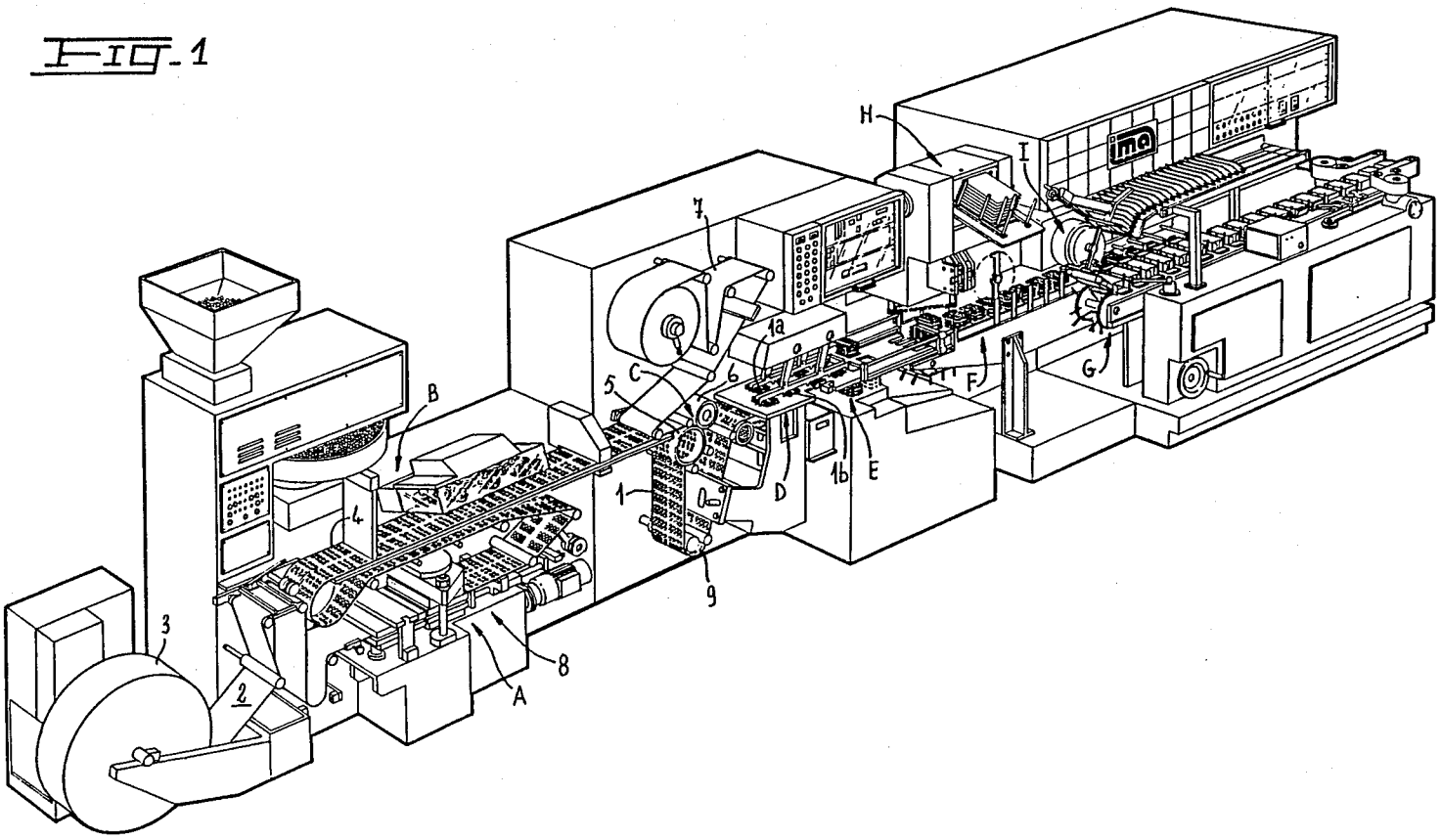
FIG. 1 is a partial front-lateral perspective view of a blister packaging machine incorporating the supply apparatus of the invention.

Substantially, in the packaging machine for blister packs comprises the supply apparatus of the invention shown in FIG. 1 for the formation of a continuous strip 1 of blister packs having parallel multiple rows of blister-packed articles and for the separation of the individual blister packs from the strip 1 and the stacking and transport of the individual blister packs for packaging in boxes or cases. The continuous strip of blister packs (see FIG. 1) is obtained by feeding along the horizontal operating line of the machine a strip 2 of thermodeformable material unwound from a spool 3 and subjecting it to a series of operations along this operating line at the same number of operating stations of the packaging machine. These operations include subjecting the strip firstly at a station A to the action of stamping means for the formation, in transverse and longitudinal alignment, by drawing, in the strip 2 of two parallel series of blisters 4 to contain the individual products to be packaged, then conveying it by conveyor rollers 5, 6 through a station B for the supply of the products to be packaged to the blisters and finally through a station C for the hermetic closure and sealing of the blisters 4, each containing one of the products to be packaged, by the superimposition on the strip 2 of thermodeformable material formed in this way and supplied with products to be packaged, of a second strip 7, usually of aluminium which may be thermally welded to the strip of thermodeformable material 2, thereby obtaining a continuous strip 1 of blister packs having parallel multiple rows.

A continuous strip 1 of blister packs of this type is then supplied to a station D of the machine for its separation into individual blister packs 1*a* and 1*b* and these latter are passed to the station E for stacking in parallel rows and then to station F where they are longitudinally aligned in a single row and pass through the station G so that they can be inserted in container boxes supplied at a station I, passing firstly through a station H where information on the nature of the packaged product is associated with them.

A machine of this type is provided with a multiple synchronized motor drive in order to cause the strip 2 to move through the station A with a discontinuous or stepped movement for the drawingof the blisters 4 by means of stamping means 8, then, provided with blisters in this way, via the station B for the supply of the products to be packaged to these blisters and then through the station C for the closure and sealing of the products in the blisters with a continuous movement creating a loop or bend 9 up to the station D for the separation of the continuous strip of blister packs 1 into single multiple blister packs 1*a*, 1*b* in parallel rows with an alternating movement and, then through the stations E for stacking and F for aligning the stacks in a single row and the above-mentioned packaging stations H, I and G.

The apparatus of the invention for the supply and erection of flat folded tubular blanks as packaging cases incorporated in the station I of the blister packaging machine described briefly above with reference to FIG. 1 substantially comprises (see FIG. 2) a hopper or fixed store of traditional type 11 containing these flat folded tubular blanks 12 in a stacked arrangement and a support wheel provided with a continuous rotary movement of the type having angularly uniformly spaced articulated systems projecting from its periphery and shown overall by 13.

Figure 2:
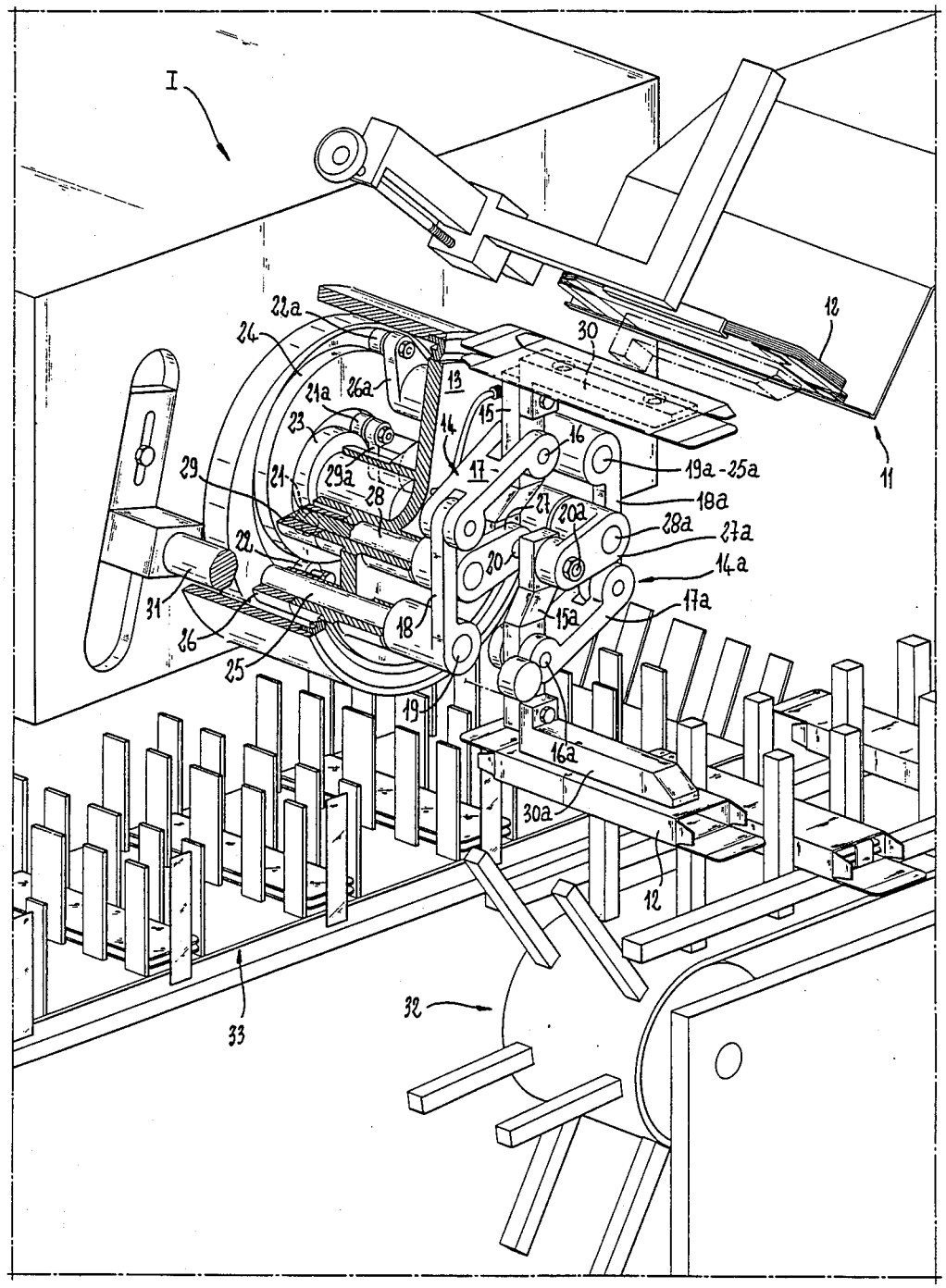
FIG. 2 is a further partial front-lateral perspective view of the apparatus of the invention on an enlarged scale with some parts removed and others in section so that other parts can be more clearly seen.

In the embodiment shown in FIG. 2, this support wheel 13 is provided with two articulated systems of the invention supported in an upturned mirror image arrangement whose overall structure, which is identical, is shown by 14 and 14*a* (see FIG. 2).

Each of these articulated systems 14, 14*a* has one of its opposite rods 15, 15*a* (rocker arms) with a longitudinal piecewise linear development, the articulation 16, 16*a* of the other rod (connecting rod) 17, 17*a* being provided at an intermediate point of the section of the piecewise linear development 15, 15*a* which projects peripherally to the greatest extent. The rod (rocker arm) opposite that with a piecewise linear development 15, 15*a* is shown by 18 and 18*a*.

The articulations 19, 19*a*; 20, 20*a* on the bridge of the articulated system 14, 14*a*, or on the wheel 13, of the opposite rods (rocker arms) 15, 18; 15*a*, 18*a* are formed as cam follower rollers 21, 21*a*; 22, 22*a*, the cam follower rollers 21, 21*a* operating in the cam throat 23 and the cam follower rollers 22, 22*a* operating in the cam throat 24.

The articulations 19, 19*a* are embodied as pins 25, 25*a* supported in a rotary manner by the body of the wheel 13, at one end of which there is fixed the corresponding rod (rocker arm) 18, 18*a* of the respective articulated system 14, 14*a* and to whose other end there is fixed a corresponding arm 26, 26*a* bearing the corresponding cam follower roller 22, 22*a* both operating in the cam throat 24, while the articulations 20, 20*a* communicate with the end of an arm 27, 27*a* whose other end is fixed to one end of a corresponding pin 28, 28*a* supported in a rotary manner by the body of the wheel 13 and to whose other end there is fixed a corresponding arm 29, 29*a* bearing the corresponding cam follower roller 21, 21*a* both operating in the cam throat 23.

At the free end of the section which projects peripherally to the greatest extent of the rod (rocker arm) 15, 15*a* of the above-described articulated systems of the invention 14, 14*a* there is associated a corresponding mechanism with suction members 30, 30*a* of known type for the take up in individual sequence of the blanks 12 from the fixed store 11 under the action of the individual cam follower structures 19, 25, 26, 22; 19*a*, 25*a*, 26*a*, 22*a*.

Figure 3:
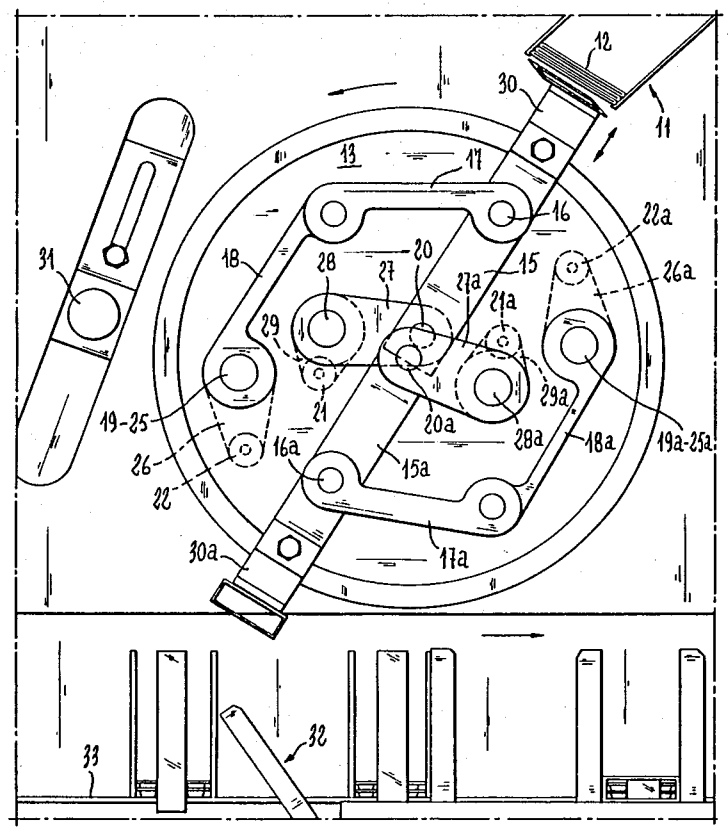
FIGS. 3, 4, 5 and 6 are operational diagrams of the apparatus of FIG. 2.
Figure 4:
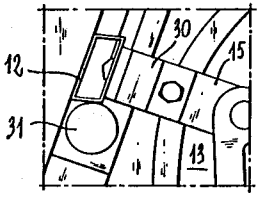
Figure 5:
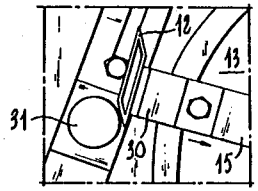
Figure 6:
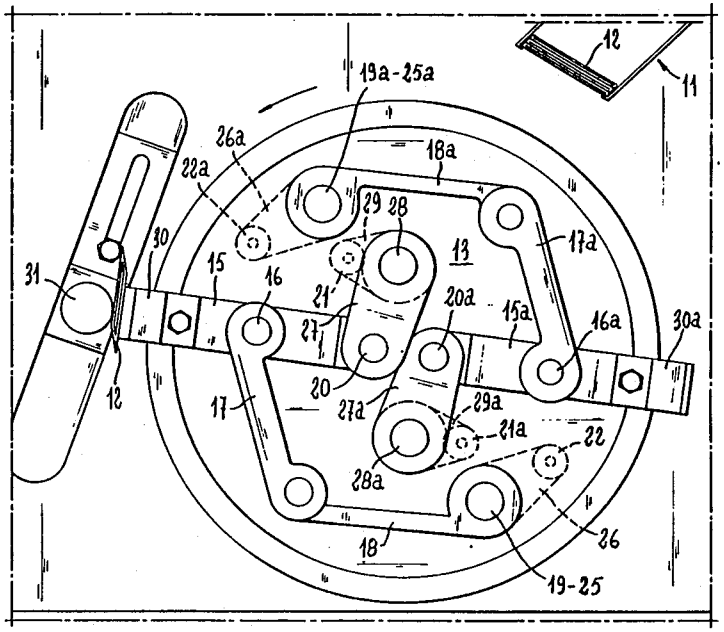

It has been observed in practice that it is possible with the wheel provided with a continuous rotary movement and provided with composite articulated systems having a simple construction of the invention to obtain high speeds of packaging in boxes per unit of time by causing the mechanisms with suction members 30, 30*a* to carry out a reciprocating movement perpendicular to the plane of the blanks 12 for their take up in individual sequence interposed with a pause (see FIG. 2) and to bring the speed of transport of the successive blanks 12 taken up in line with the needs of the box erection operation by bringing them to abut against the abutment 31 (see FIGS. 2, 4, 5 and 6) and with the speed of the conveyor device 32 (see FIGS. 2 and 3) for the supply into its container pockets of the blanks erected in this way to receive the products to be packaged internally conveyed by the conveyor 33 in alignment therewith (see FIG. 2 in particular).

The description of the apparatus in question made with reference to the attached drawings is obviously given solely by way of non-limiting example and it is thus evident that any modifications or variants suggested by practice and by its embodiment and use can be made thereto without departing from the scope of the following claims.

We claim:

1. An apparatus for supplying a succession of flat folded tubular blanks from a store of said blanks to a packaging location in a packaging machine, comprising:

a continuously rotatable support wheel;

a plurality of articulated systems on said wheel, each of said systems including:

an elongated arm having an end projecting beyond a periphery of said wheel and formed with an opposite end, a first link articulated to said opposite end of said arm and swingable on said wheel about a first pivot axis, a connecting rod pivotally connected to said arm at a location between said ends, a second link articulated to said rod and pivotally mounted on said wheel at a second axis, a first cam follower rotatable about said first axis and connected to said first link so as to angularly displace said first link about said first axis, and a second cam follower rotatable about said second axis and connected to said second link so as to angularly displace said second link about said second axis;

respective stationary cams adjacent said wheel engageable by said first and second cam followers of each of said articulated systems and imparting a reciprocating movement to said arms as said wheel is continuously rotated with a pause as said ends projecting beyond said wheel reach said store for pickup of a respective blank; and suction means on each of said ends projecting beyond said wheel and activatable to seize a respective one of said blanks during a respective pause.

2. The apparatus defined in claim 1 wherein said arm is a stepped bar with each of said ends on a portion offset from the other end.

3. The apparatus defined in claim 1 wherein said wheel is formed with first and second shafts respectively defining said first and second axes of the respective articulated systems, each first shaft connecting the respective first link with the respective first cam follow-up and each second shaft respectively connecting each second link with the respective second cam follower.

* * * * *